US005302072A

United States Patent [19]

Stauffer et al.

[11] Patent Number: 5,302,072

[45] Date of Patent: Apr. 12, 1994

[54] TRACKSIDE DOOR CLOSING DEVICE FOR RAILWAY HOPPER CARS

[75] Inventors: Rick J. Stauffer; Keith C. Kieres, both of Overland Park, Kans.; Lyle W. Burr, Lincoln, Nebr.

[73] Assignee: Burlington Northern Railroad Company, Fort Worth, Tex.

[21] Appl. No.: 944,497

[22] Filed: Sep. 14, 1992

[51] Int. Cl.[5] ..... B61D 7/30

[52] U.S. Cl. ..... 414/387

[58] Field of Search ..... 105/241.2, 238, 247, 105/248, 249, 250, 311.1, 280, 355, 404; 414/387, 388, 438

[56] References Cited

U.S. PATENT DOCUMENTS 2,451,406 10/1948 Pancake ..... 414/387
2,686,605 8/1954 Kepner .
3,606,042 9/1971 Schuller ..... 414/438
3,891,101 6/1975 Peterson .
4,011,956 3/1977 Green et al. .
4,062,460 12/1977 Adler .
4,120,412 10/1978 Miller et al. .
4,213,725 7/1980 Knippel .
4,358,238 11/1982 Ely ..... 414/387
4,754,710 7/1988 Kieres .

*Primary Examiner*—Mark T. Le
*Attorney, Agent, or Firm*—Merchant, Gould, Smith, Edell, Welter & Schmidt

[57] ABSTRACT

A trackside device for closing hopper doors (14) has an eccentrically rotatable wheel (18). The wheel (18) rotates upon contacting a hopper door (14) to move it inward to a closed position. In a preferred embodiment, two devices are positioned on opposite sides of a railroad track to simultaneously close doors (14) on both sides of the hopper car.

11 Claims, 4 Drawing Sheets

FIG. 1
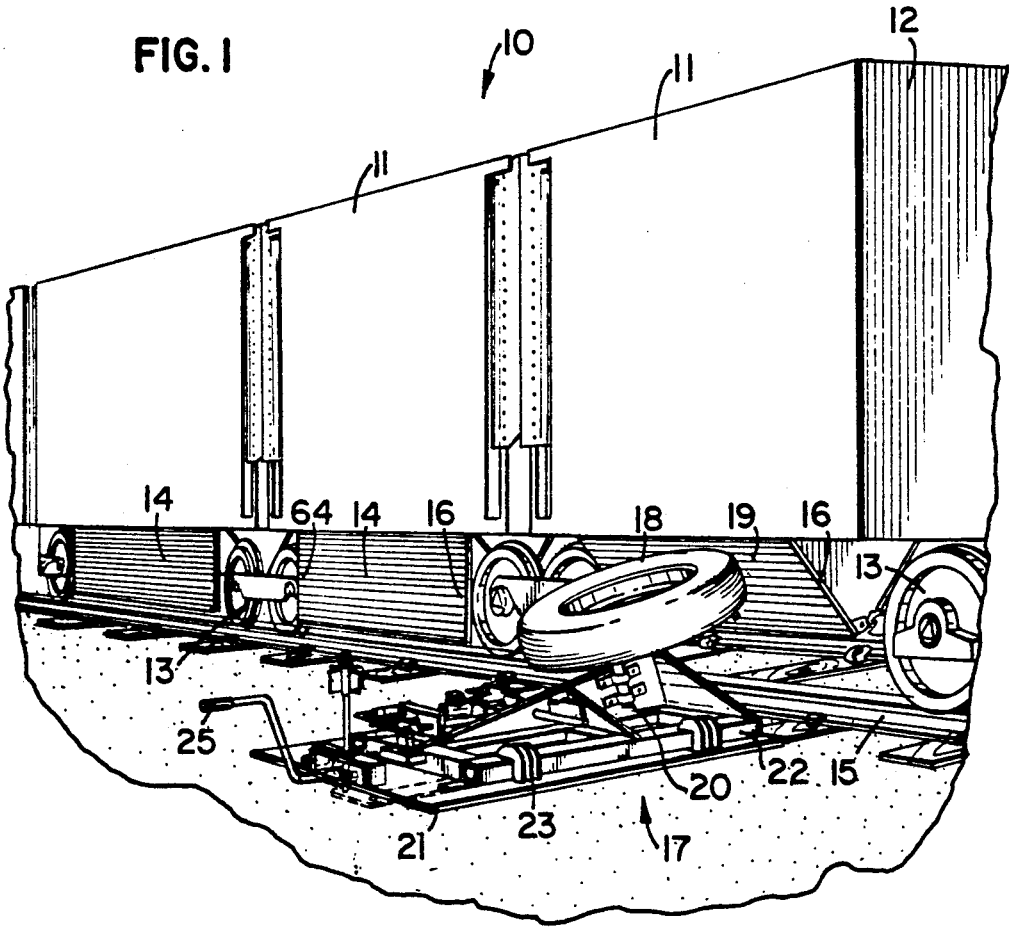
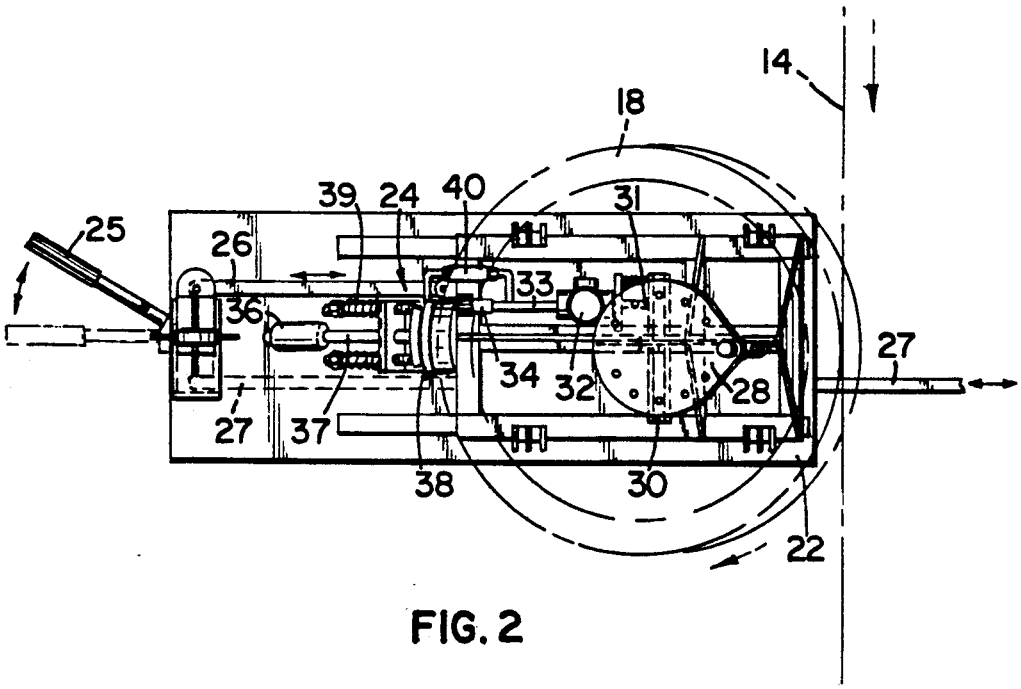
FIG. 2

FIG. 4
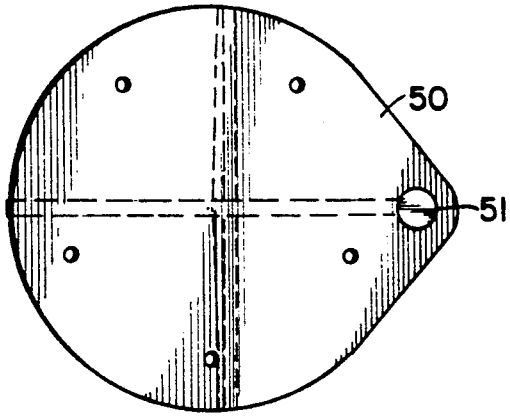
FIG. 5
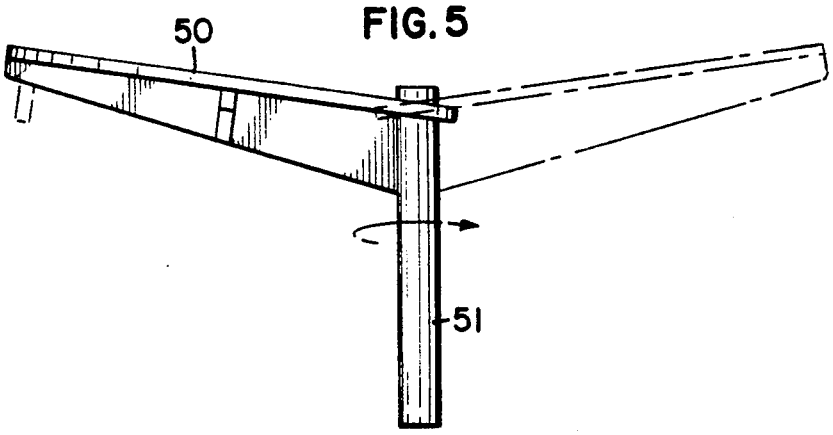
FIG. 6
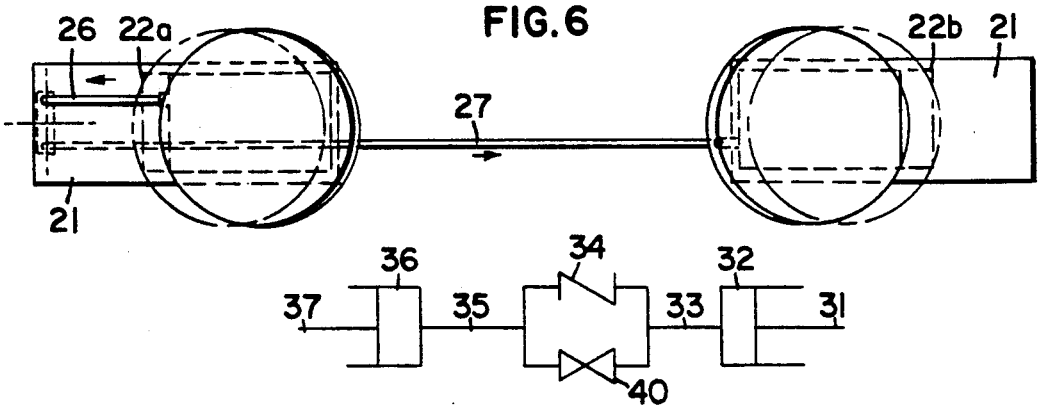
FIG. 7

TRACKSIDE DOOR CLOSING DEVICE FOR RAILWAY HOPPER CARS

FIELD OF THE INVENTION

The present invention relates to railway hopper cars which discharge materials through discharge openings located proximate the bottom of a hopper car which openings are normally closed by means of moving swinging doors inward to a closed position. More particularly, the invention relates to a trackside device for closing hopper car doors as the car travels along the track adjacent to the device.

BACKGROUND OF THE INVENTION

The trackside closure devices for bottom and side discharge and railway hopper cars have gone through substantial development over the years. Several devices have used rotating closure members for engaging a fitting on the hopper door. Peterson, U.S. Pat. No. 3,891,101, discloses a trackside closure device which uses a rotating mechanism having three radially-spaced actuating arms to close bottom doors on moving hopper cars. The arms have ball-ends which are resiliently mounted to absorb shock, and the ball-ends engage a socket on the car door to force the door closed before the receiving socket opens to allow disengagement of the actuating arm. The arms must be carefully indexed to provide for proper positioning of the arm for accurate engagement of the socket on the next hopper door.

Green et al., U.S. Pat. No. 4,011,956, discloses a modification of the Peterson closure mechanism. The Green mechanism includes a single rotating actuating arm adapted to engage a socket in the doors of a hopper car as they move along a track adjacent to the closure mechanism. Again, the actuating arm has an engaging member located at its end. The engaging member is resiliently mounted (telescoping) in the actuating arm to allow for substantial compression of the actuating arm. After closing the hopper car door, the actuating arm is released from the socket, the arm maintains a compressed configuration, an electric motor returns the actuating arm in the compressed configuration toward an indexed position to wait for the next door, the actuating arm is extended to full length, and arrives at the indexing position. Because the actuating arm completes the closure process at a point removed from the indexing position, there is a time delay during which the arm resets. This time delay can limit the speed at which the train can move during the closure operation.

Both the Peterson and Green et al. references require careful control of the relative position of the end of the actuating arm and the socket on the hopper car door to ensure proper cooperation of the device in closing the door. Further, these devices are susceptible to deformation of the actuating arms which would impair the ability of the end to be accurately positioned with respect to the hopper car door and in the telescoping arrangement within the arm itself. In addition, the Green device requires an electric motor to return the actuating arm to the indexed position, and the recovery time required to reposition the arm may limit the train's speed during the operation. Therefore, more durable and simple closure mechanisms are required which have essentially no recovery time.

Miller et al., U.S. Pat. No. 4,120,412, discloses a trackside closing arrangement for railway hopper cars including a pair of pneumatic tires and wheels mounted on a pivot arm. The tires rotate in an essentially horizontal plane and are inter-connected and mounted concentrically on the pivot arm at trackside to contact and close hopper doors on railway cars. Unlike the Peterson and Green references, the closure devices of Miller et al. do not appear to be capable of projecting into or underneath a hopper car to close a door. Therefore, the hopper doors of Miller et al. project outward from the car to contact the closure device. In addition, a pair of closure mechanisms positioned on opposite sides of a railroad tack are linked to provide coordinated movement and maintain contact with a swaying hopper car.

Railway hopper cars are often utilized in unit train operations. Such trains consist entirely of hoppers carrying coal or other comminuted materials which are dumped downwardly through the tracks into a suitable bin arrangement when the train arrives at its destination. A recent development in such unit trains is disclosed in Kieres, U.S. Pat. No. 4,754,710. Kieres discloses a segmented railway car which can be 500 feet long. The end of each segment is supported by wheel-containing truck means. The railroad car of Kieres includes a plurality of side discharge openings closed by swinging doors. These doors close on sills and can be wholly within the region defined by the vertical side walls of the car. In order to close these doors, it may be necessary that a closure device extend into or underneath a hopper car.

Trackside hopper car door closing mechanisms have addressed the interaction between the mechanism and car door in several ways. One way has been the "ball and socket" arrangement of Peterson and Green. This arrangement requires controlled relative positioning between the mechanism and a socket on the car door. In addition, the socket must be capable of releasing the ball end of the actuator arm flawlessly. The "ball and socket" type of closure mechanism is susceptible to damage and misalignment. Further, Green requires an electric motor to return the actuating arm to an indexed position. In an attempt to avoid the problems inherent in the "ball and socket" arrangement, Miller utilizes a pair of rotating pneumatic tires which contact modified hopper car doors. However, this arrangement requires that the hopper car doors be moved to project beyond the car body. This is necessary as the Miller device does not appear capable of projecting into or under a hopper car.

Therefore, a new trackside door closure device is needed which (1) is versatile and can operate with hopper car doors which project beyond a car body or which can itself project into or under a hopper car, (2) is durable and resilient resisting permanent deformation and misalignment, (3) which returns to an indexed or ready position before a newly closed hopper door moves from vicinity of the mechanism to be ready for the next open door and (4) which does not require electrical energization means.

SUMMARY OF THE INVENTION

The invention is directed to a trackside door closing device for use with railway hopper cars. The device is for use with a railway hopper car which moves with respect to the closure device having a door which closes by moving towards the interior of the car from the open position to latch in a closed position. The doors may be suitably latched by locking mechanisms known in the art. The closing device is positioned adjacent a railway track and has an eccentric means for closing the moving hopper door operably connected to and rotatable about an axle lying outside of a horizontal plane which is defined by the railroad track. The eccentric means is arranged and configured to contact the moving hopper door proximate a leading portion of the door while in an open position, maintain rolling contact with the door while moving the door inward to a closed position and releases contact with the door at a position substantially removed from a leading portion from the door after the door is closed.

In a preferred embodiment, there is a pair of trackside closing devices located on opposite sides of a railroad track. The preferred trackside closing devices incorporate a pneumatic tire mounted eccentrically on an oblique axle. The devices are mounted on a sliding carriage which can move the devices into or away from the nearby track. This allows the tires to be moved away from the track to allow a locomotive, etc., to pass and to be moved inward to allow the tires to contact and close the hopper car doors. In addition, the preferred embodiment includes a braking mechanism to position the tire in an indexed or ready position.

BRIEF DESCRIPTION OF THE DRAWING

FIG. 1 is a perspective view of a railway hopper car positioned on a railroad track and a trackside door closing device of the present invention;

FIG. 2 is a plan view of the trackside door closing device;

FIG. 4 is a top view of an alternative embodiment tire mounting plate;

FIG. 5 is a side view of the alternative embodiment of FIG. 4;

FIG. 6 is a schematic plan view showing the linkage between a pair of the trackside door closing devices; and FIG. 7 is a block diagram of the hydraulic braking mechanism of the present invention.

DETAIL DESCRIPTION OF A PREFERRED EMBODIMENT

Figure 3:
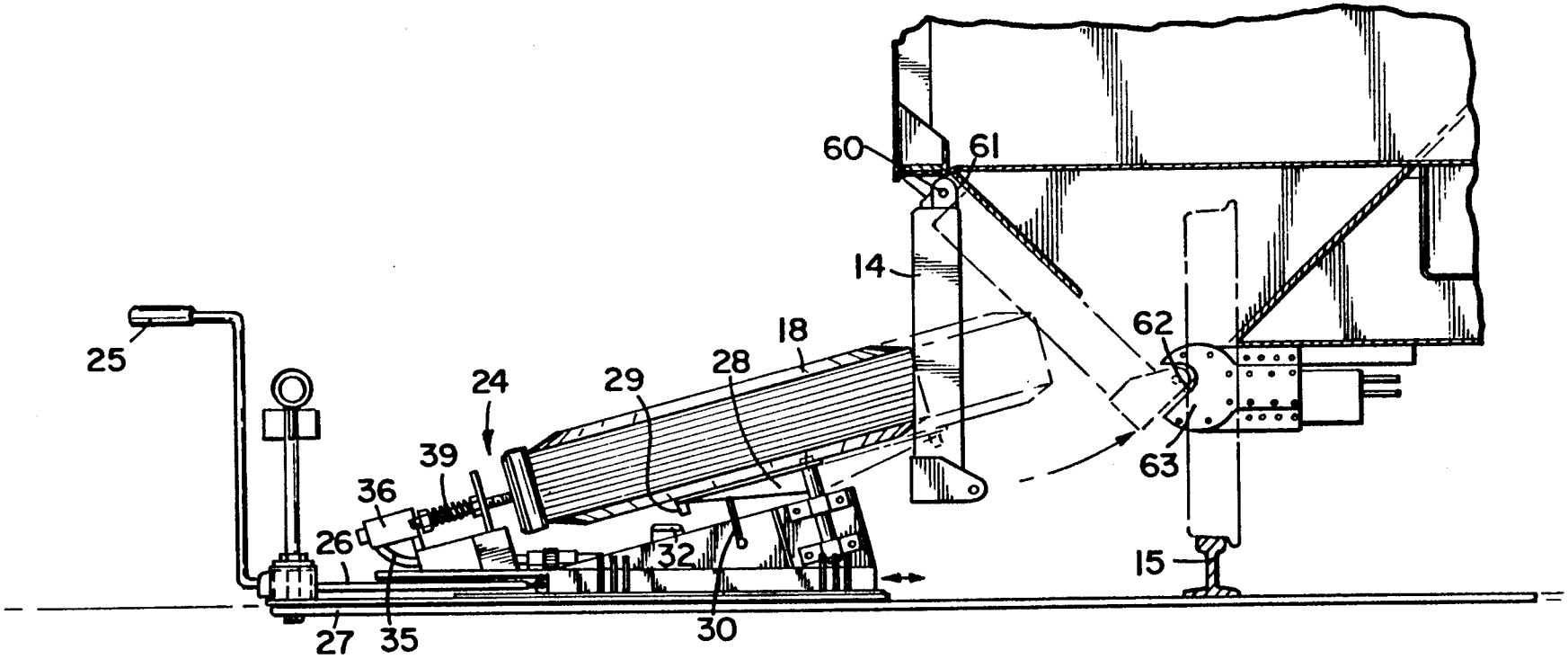
FIG. 3 is a side elevation of a trackside door closing device showing its operation.
Figure 8:
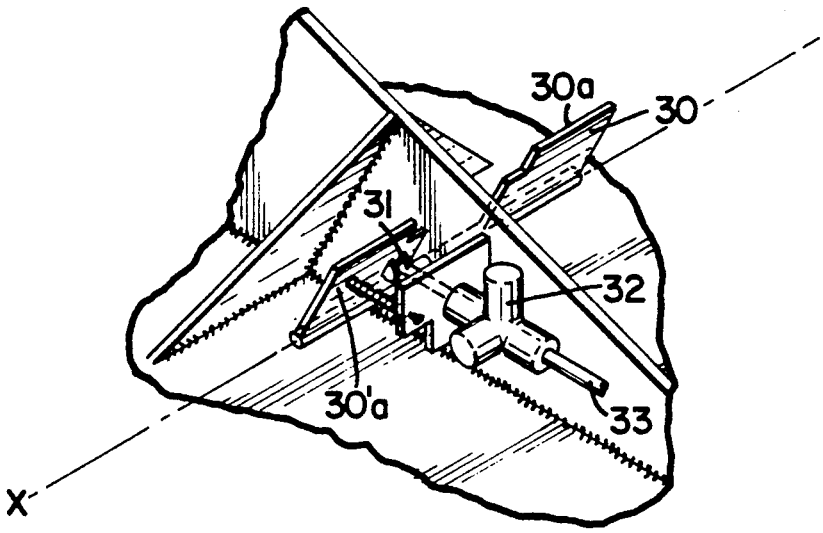
FIG. 8 is a perspective view of the hydraulic system.

The description of the invention is discussed with reference to a segmented railway hopper car as disclosed in Kieres, U.S. Pat. No. 4,754,710, herein incorporated by reference. However, it will be understood by those skilled in the art that the present invention can be used with any hopper car having doors which move inwardly to latch in a closed position. These doors may be hingedly mounted on a longitudinal side sill, slidably mounted proximate the bottom edge of a hopper car, etc.

As shown in FIG. 1, segmented railway hopper car 10 comprises segmented sidewalls 11 and an end wall 12. The car is supported on wheel trucks 13 between the segments and at each end of the hopper car 10. Between wheel trucks 13, are located hopper doors 14. As the hopper car 10 moves along a railroad track 15 a leading portion 16 of the hopper door 14 contacts a portion of the door closing device generally shown at 17. In particular, the leading edge 16 contacts an eccentric means for closing a moving hopper door. The eccentric closure means may be any device which provides eccentric motion about an axis. The eccentric closure means can be a disk which rotates about an eccentric axis, an ellipsoid which rotates about an axis which may be a focus of the ellipse, a projection on a disk, etc. Preferably, the eccentric closure means is a pneumatic tire 18 mounted on a wheel 18*a*. The contact between the door 18 and the tire 18 causes the tire 18 to rotate in the direction shown by arrow 19.

The wheel 18*a* is eccentrically mounted on and rotatable on an axle 20. The axle 20 is mounted outside of a horizontal plane defined by the railroad track 15. In the preferred embodiment, the axle 20 is positioned at an oblique angle to the horizontal plane, and in a most preferred embodiment, the axle is mounted perpendicular to an inclined plane which intersects the horizontal plane of the base 21 of the door closure mechanism 17 in a line which is parallel to the railroad track 15. The axle 20 lies between the line defining the intersection of the planes and the railroad track 15.

The axle 20 is operatively connected to a carriage 22 which is slidably mounted on the base 21 by means of guides 23 to allow the carriage 22 to slide in an essentially horizontal plane on the base 21 in a direction perpendicular to the railroad track 15. The carriage 22 further comprises means 24 for positioning the wheel 18 in an indexed position. The term "indexed position" is a position or range of positions of the tire 18 or other eccentric closure means which is an optimal position for engaging the leading edge 16 of a hopper door 14. A preferred indexed position has the tire 18 generally at rest wherein a short radius from the axle to the nearest point on the circumference the tire 18 is generally disposed toward the rail road track 15, and a long radius from the axle 20 to a most distant point on the circumference of the tire 18 is generally disposed toward the brake pad 38. A tire 18 at rest in the indexed position is illustrated in FIG. 3.

Finally, the closure mechanism 17 may include lever means 25 and a connecting rod 26 to slidably move the carriage 22 in toward and away from the railroad track 15. The door closing system of the present invention may include a pair of door closure mechanisms 17 located on opposite sides of a railroad track 15 as illustrated in FIG. 6. In such instance, the lever means 25 may also be connected to a second connecting rod 27 to slidably move a second carriage 17*b* in towards and away from a railroad track 15. Preferably, the arrangement between the lever means 25 and connecting rods 26 and 27 provides for coordinated movement of the two carriages 22*a* and 22*b* such that both move in towards or away from the associated railroad track 15.

FIGS. 2 and 3 illustrate the closure device 17 in somewhat greater detail. The tire 18 is mounted on a wheel 18*a* which is operatively connected to a mounting plate 28. The mounting plate is rotatably connected through an axle 20 to the carriage 22. The mounting plate 28 may rotate on the axle 20, the axle 20 may rotate with respect to the carriage 22 or both. The mounting plate 28 may be connected to the axle 20 through welding or it may be through rotating roller bearing arrangement, etc. The axle 20 may be connected to the carriage 22 through welding, strapping, set-screws, rivets, cotter or shear pins, bolting, etc.; a socket; friction fitting; adhesives; etc., or it may be through a rotating rolling bearing arrangement. The mounting plate 28 has an extension 29 which acts as a trigger for the positioning means 24.

In a preferred embodiment, the positioning means 24 is a hydraulic brake assembly. The discussion of this assembly is illustrated in FIGS. 1, 3, and 7. A hydraulic brake assembly is made up an actuator arm 30 which is connected to a piston 31 which can direct hydraulic fluid from an actuating cylinder 32 through conduit 33, a check valve 34, an additional conduit 35 and to a brake cylinder 36. In operation, the tire 18 rotating in direction 19 carries extension pin 29 across the actuator arm 30. The pin 29 contacts the actuator arm 30 proximate a top portion 30*a* thereof. The movement of the pin 29 across the actuator arm 30 rotates arm 30 about its axis X. This rotation transfers movement to a top portion 30*a'* of the actuator arm 30 which is operatively connected to the piston arm 31. Forcing hydraulic fluid into the brake cylinder 36 extends a piston 37 and brake pad 38 mounted thereon toward the rotating tire 18 to stop the rotation of a tire 18 by contacting the long radius of the tire in an indexed position. The brake pad 38 is then moved away from and generally held away from the tire 18 by means of springs 39 while the hydraulic fluid bleeds back to the actuating cylinder 32. Of course, the brake pad need not operate on the tire itself. In another embodiment, the hydraulic brake system can act on a rotating axle, or on a disc mounted on the mounting plate or about the axle.

The operation of the hydraulic braking system is described in greater detail in FIG. 7. Action by the trigger 29 on the actuating arm 30 drives a piston 31 into an actuating cylinder 32. The action of the piston 31 drives hydraulic fluid through conduit 33, check valve 34, and conduit 35 into brake cylinder 36 forcing piston 37 and brake pad toward the rotating wheel 18. Springs 39 act on brake pad 38 and piston 37 to force hydraulic fluid through brake cylinder 36 back through conduit 35 and bleeder valve 40 into conduit 33 and actuating cylinder 32. The action of the springs 39 on the hydraulic system, e.g., 24 results in the brake pad 38 being retracted from the wheel 18 allowing free movement thereof.

In another embodiment, the positioning means 24 is essentially internal to the tire 18. The alternative positioning means is not illustrated, and it comprises a tire inner tube, a pair of baffles and a dense, viscous fluid. The fluid is placed inside the inner tube of the tire. The baffles are simply inner tube cross sectional area restrictions to control the fluid flow, and they may be located at about the 4 o'clock and 8 o'clock positions when the tire is in the indexed position. At this position, the fluid resides at the lowest level in the tube between the two baffles. As the tire comes into contact with the rail car door, the tire starts to slowly rotate. The fluid remains at the lowest level within the tube and flows through the baffle without impeding the rotation of the tire significantly, due to the slow rotation speed. As the tire rotates past its fully extended position it begins to accelerate as it falls to its neutral position. The baffles then come into contact with the fluid as the tire rotates. The motion of the tire is substantially slowed by the fluid because of the restricted flow through the baffled inner tube at the faster rotational speed.

The angle between the mounting plate 28 and axle 20 is about 90° in one preferred embodiment, illustrated in FIGS. 1-3. In an alternative embodiment illustrated in FIGS. 4 and 5, the angle between the mounting plate 50 and axle 51 is greater than 90°. Such an arrangement provides a tire 18 which is more nearly horizontal in the indexed position and more nearly vertical when rotated 180° from the indexed position. This configuration provides a greater vertical closing force on the hopper car door 14.

In operation, a railroad hopper car 10 is conducted along a railroad track 15 past a door closure mechanism 17. A leading portion 16 of the hopper car door 14 contacts the tire 18 in the indexed position. Friction between the tire 18 and door 14 imparts rotation to the eccentrically mounted tire 18. During the rotation of the tire from the indexed position, the radius between the axle 20 and the hopper car door 14 increases, rotates the door 14 on a hinged mounting 60 on a longitude side-sill 61 inward and upward to a closed position (illustrated in phantom in FIG. 3) on an inner sill 62. The door 14 is then latched in the closed position by means of a locking mechanism 63. Preferably, friction between the tire 18 and door 14 causes a rotation of the tire 18 such that at a point approximately midway between the leading edge 16 and trailing edge 64 of the hopper door, a maximum radius between the axle 20 and door 14 is attained and the door 14 is latched in a closed position. The tire 18 continues to rotate, and the radius between the axle 20 and the door 14 decreases until the tire 18 and door 14 lose contact. Gravitational forces then continue rotation of the tire 18 about the axle 20 toward the indexed position. During this rotation, the trigger 29 contacts the actuator arm 30 forcing the piston 31 into the actuating cylinder. As described above, this motion moves the brake pad 38 into position to contact the rotating tire 18. Friction between the brake pad 38 and rotating tire 18 substantially terminates the rotation of the tire 18 to rest or oscillate minimally in the indexed position. The tire 18 is then in position to repeat the above sequence with the next hopper door 14. The sequence is repeated until all doors 14 on the train 10 have been closed. After the last door 14 has been closed, an operator can manipulate the lever means 25 to retract the carriage 22 away from the railroad track 15. Thereafter, the door closure mechanism 17 does not contact or otherwise impair the passage of additional rail traffic.

Other modifications of the invention will be apparent to those skilled in the art in light of the foregoing description. This description is intended specific examples of individual embodiments which clearly disclose the present invention. Accordingly, is not limited to these embodiments or to the use of elements having to provide specific configuration and shapes as presented herein. All alternative modifications and variations of the inventions which follow in the spirit and broad scope of the appended claims are included.

What is claimed is:

1. For use with a railroad hopper car having a door, which closes by moving towards the center of the car from an open position to a closed position as the hopper car moves along a railroad track, a closing mechanism comprising:

(a) a first means for closing a moving hopper door, the first means eccentrically rotatable about an axis lying outside of a horizontal plane adjacent a railroad track, arranged and configured to contact the moving hopper door at a leading portion thereto while in the open position, to maintain rolling contact with the door while moving the door inward to a closed position, and to release contact from the door at a point substantially removed longitudinally from the leading portion after closing the door;

(b) mounting means for maintaining the first means adjacent the railroad track.

2. The closing mechanism of claim 1 wherein the mounting means comprises an axle.

3. The closing mechanism of claim 2 wherein the axle is fixedly positioned at an oblique angle with respect to a horizontal plane essentially defined by the railroad track adjacent the axle.

4. The closing mechanism of claim 1 wherein the first means comprises an essentially cylindrical member having a height substantially less than a radius.

5. The closing mechanism of claim 4 wherein the cylindrical member comprises a tire.

6. The closing mechanism of claim 2 wherein the first means is operatively connected perpendicular to the axle.

7. The closing mechanism of claim 1 which further comprises means to control revolution of the first means.

8. For use with a side-discharge railroad hopper car having a pair of doors hingedly mounted on opposite longitudinal side sills, which doors rotate inwardly and upwardly from an open position to a closed position as the hopper car moves along a railroad track, a closing mechanism comprising:

(a) a pair of bases mounted on opposite sides of and adjacent the railroad track;

(b) a carriage slidably mounted on each base which is arranged and configured to slide in an essentially horizontal plane on the base in a direction perpendicular to the railroad track;

(c) means operatively connected to each carriage for synchronized movement of the carriages inward toward the railroad track and outward from the railroad tack;

(d) an axle operatively connected to each carriage inclined away from the railroad track;

(e) a wheel eccentrically mounted on and rotatable about each axle wherein the wheel has a short radius and a long radius between the axle and circumference, the wheel having a ready position wherein the short radius is essentially directed toward the railroad track, and the wheel in the ready position contacts a moving hopper door which is in an open position at a point on the circumference near the short radius, rotates about the axle to maintain contact with the door while moving the door inward to a closed position and releases contact with the door after closing the door, the radius between the axle and point of contact between the wheel and hopper door substantially increasing from the short radius to the long radius during contact between the wheel and hopper door; and (f) means for positioning the wheel in the ready position.

9. A method for closing a door hingedly mounted on a longitudinal side sill of a side-discharge railroad hopper car, the method comprising:

(a) moving the hopper car along a railroad track;

(b) contacting the hopper car door with an eccentric, rotatable closure device eccentrically mounted on an axle and having a periphery which is positioned adjacent the railroad track; and (c) imparting rotation to the closure device wherein the periphery of the closure device travels along the door and a radius between the axle and the hopper car door increases whereby the hopper car door rotates inwardly and upwardly from an open position to a closed position on an inner sill of the hopper car.

10. The closing mechanism of claim 8 wherein the positioning means comprises a hydraulic brake assembly having a brake cylinder.

11. The closing mechanism of claim 10 wherein the wheel further comprises a trigger member arranged and configured to initiate operation of the hydraulic brake assembly.

* * * * *